US011771205B2

(12) United States Patent
Samangooie

(10) Patent No.: US 11,771,205 B2
(45) Date of Patent: Oct. 3, 2023

(54) IMPREGNATABLE PAD APPLICATOR STORAGE AND WARMING DEVICE

(71) Applicant: CaseMed Engineering, LLC, Waukegan, IL (US)

(72) Inventor: Casey Samangooie, Wadsworth, IL (US)

(73) Assignee: CaseMed Engineering, LLC, Waukegan, IL (US)

( * ) Notice: Subject to any disclaimer, the term of this patent is extended or adjusted under 35 U.S.C. 154(b) by 682 days.

(21) Appl. No.: 16/774,022

(22) Filed: Jan. 28, 2020

(65) Prior Publication Data

US 2020/0237080 A1 Jul. 30, 2020

Related U.S. Application Data

(60) Provisional application No. 62/797,931, filed on Jan. 28, 2019.

(51) Int. Cl.

| | |
|---|---|
| ***A45D 44/02*** | (2006.01) |
| ***H05B 3/02*** | (2006.01) |
| ***H05B 3/34*** | (2006.01) |

(52) U.S. Cl.

CPC ..... *A45D 44/02* (2013.01); *H05B 3/02* (2013.01); *H05B 3/34* (2013.01); *A45D 2200/155* (2013.01); *H05B 2203/03* (2013.01)

(58) Field of Classification Search

CPC ..... A61B 50/10; A45D 2200/155

See application file for complete search history.

(56) References Cited

U.S. PATENT DOCUMENTS

| | | | | |
|---|---|---|---|---|
| 5,473,975 | A * | 12/1995 | Bruno | A47J 37/044 99/335 |
| 6,186,977 | B1 * | 2/2001 | Andrews | A61B 50/10 604/67 |
| 6,259,067 | B1 * | 7/2001 | Fanes, Jr. | A61B 50/10 219/394 |
| 2007/0215634 | A1 * | 9/2007 | Levin | A61M 5/44 221/231 |
| 2016/0234887 | A1 * | 8/2016 | Buckalter | H05B 6/108 |
| 2017/0028196 | A1 * | 2/2017 | Stopperan | A61N 1/36021 |

* cited by examiner

*Primary Examiner* — John J Norton
*Assistant Examiner* — Simpson A Chen
(74) *Attorney, Agent, or Firm* — Flener IP & Business Law; Zareefa B. Flener

(57) ABSTRACT

An impregnatable pad applicator storage and warming device for storing at least a first impregnatable pad applicator for a cosmetic preparation, a sundry preparation, a topical medication, or topical pharmaceutical, and warming these contents thereof comprises: a housing including an upper housing element and a lower housing element, the housing elements attached by a connector; a storage unit configured to receive and store at least a first impregnatable pad applicator; a warming unit comprising a power supply, controller, and a first heating element; and a first warming chamber configured to receive a first impregnatable pad applicator and transfer heat from the first heating element to the contents of the warming chamber.

14 Claims, 4 Drawing Sheets

IMPREGNATABLE PAD APPLICATOR STORAGE AND WARMING DEVICE

CROSS-REFERENCE TO RELATED APPLICATION

This application claims the benefit of U.S. Provisional Application No. 62,797931 filed Jan. 28, 2019.

FIELD OF INVENTION

The present invention relates to a portable storage and warming device for impregnatable pad applicators of various size and configuration and holding various contents. The impregnatable pad applicators and the storage and warming device is useful across a number of industries, including, but not limited to, cosmetics and sundry, and medical/topical pharmaceuticals.

SUMMARY OF INVENTION

A storage and warming device for storing at least a first impregnatable pad applicator and warming the contents thereof comprises: a housing including an upper housing element and a lower housing element, the housing elements attached by a connector; a storage unit configured to receive and store at least a first impregnatable pad applicator; a warming unit comprising a power supply, controller, and a first heating element; and a first warming chamber configured to receive a first impregnatable pad applicator and transfer heat from the first heating element to the contents of the warming chamber. The contents of the impregnatable pad applicator is a cosmetic preparation, a topical medication, or a topical pharmaceutical.

In a first embodiment of the invention, the storage unit, the warming unit, and the first warming chamber are located in the lower housing element. The storage unit comprises a plurality of storage receptacles and a first of the plurality of storage receptacles aligns with and is in communication with the first warming chamber. A second of the plurality of storage receptacles may align with and in communication with a second warming chamber. The controller energizes the first heating element with power from the power supply to elevate the temperature of the first heating element to a first, predetermined temperature for a predetermined time period. The first heating element is formed into a raceway defining the first warming chamber and comprises a polyimide film and filament flexible heating pad. In another embodiment of the invention a first heating element and second heating element are disposed in the upper housing portion in opposing positions to define the first warming chamber. An embodiment of the invention further comprises powered port configured recharge the power supply and provide power to an auxiliary device.

DETAILED DESCRIPTION OF DRAWINGS

Figure 13:
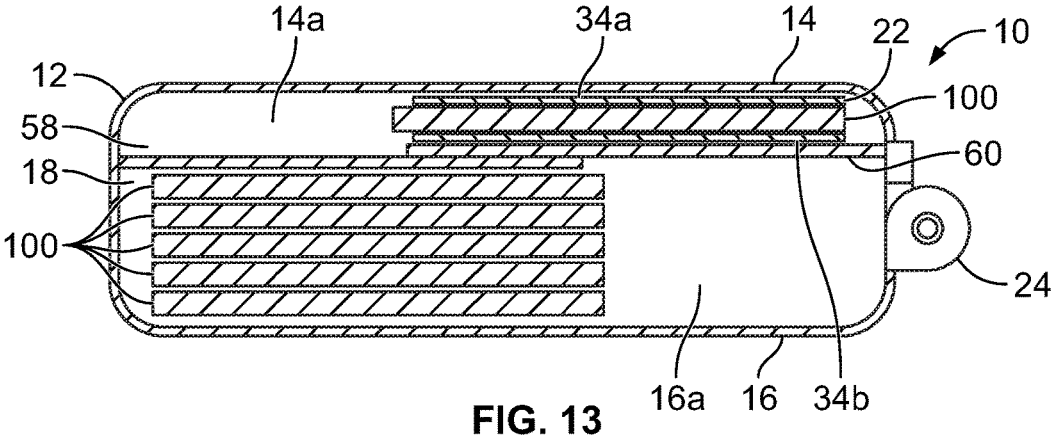
FIG. 13 is a cross section view of the invention shown in FIG. 9 taken along Line 13-13 in FIG. 11.
Figure 14:
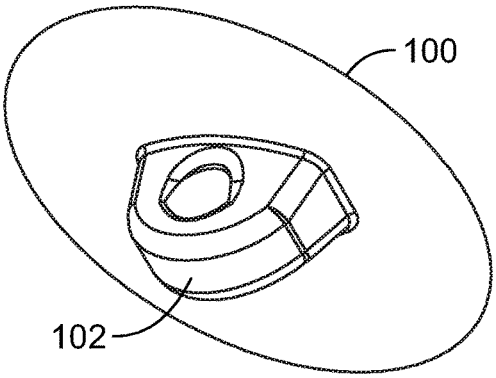
FIGS. 14-15 are isometric views of impregnatable pad applicators.

FIGS. 1-13 show embodiments of the present inventive impregnatable pad applicator portable storage and warming device for impregnatable pad applicators carrying a small amount or single dose of a cosmetic, medicinal, or pharmaceutical preparation. Like or identical elements in each figure will be identified with the same reference number whenever possible. The inventive device 10 generally comprises a housing 12 with an upper and lower housing element 14, 16, a storage unit 18, a warming unit 20, and at least a first warming chamber 22 for heating the contents of the impregnatable pad applicator 100 (FIG. 14, 15). The overall dimensions of the housing 12 are chosen to enable ease of transport of the device 10 in a purse, backpack, satchel, or similar personal items carrying device and for ease of operation, e.g., ability to hold the device in one hand. The upper and lower housing elements 14, 16 each comprise an internal compartment 14*a*, 16*a* in the form of a space or well for receiving, defining, and/or holding components of the device. The upper and lower housing elements 14, 16 are attached with a connector 24 forming a clamshell type housing. The inventive device 10 stores impregnatable pad applicator holding defined quantities or doses of fluid or cream cosmetic preparations, or topical medicines and pharmaceuticals. Upon activation of the device 10, the contents of an impregnatable pad applicator within the device are warmed to a selected temperature. The device user has a comfortably warmed preparation to apply to their skin avoiding the discomfort of cold lotions and difficulty of application of preparations that have become too thick to properly apply due to a cold environment.

Turning first to FIGS. 1-8, a first embodiment of the inventive impregnatable pad applicator storage and warming device 10 is shown. In this embodiment, the upper housing element 16 functions as a lid for the housing 12. The internal compartment 14*a* of the lower housing element 14 forms a well or space to receive the storage unit 18, the warming unit 20, and the first warming chamber 22. The connector 24 between the upper and lower housing elements 14, 16 is a hinge with a first hinge portion 24*a* on the upper housing element 14 and a second hinge portion 24*b* on the lower housing element 16.

Figure 1:
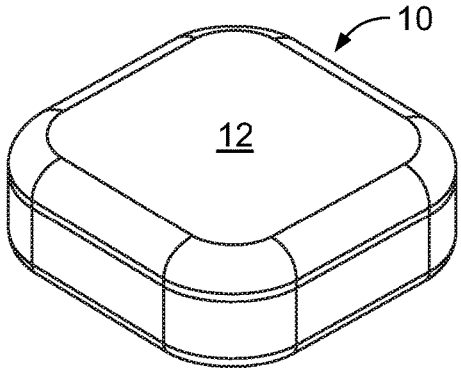
FIG. 1 is an isometric view of a first embodiment of the present invention.
Figure 2:
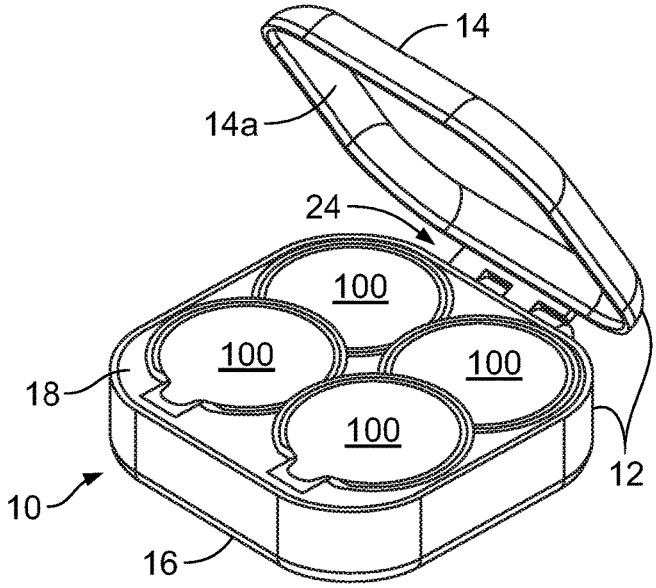
FIGS. 2-4 are additional isometric views of the invention shown in FIG. 1.
Figure 4:
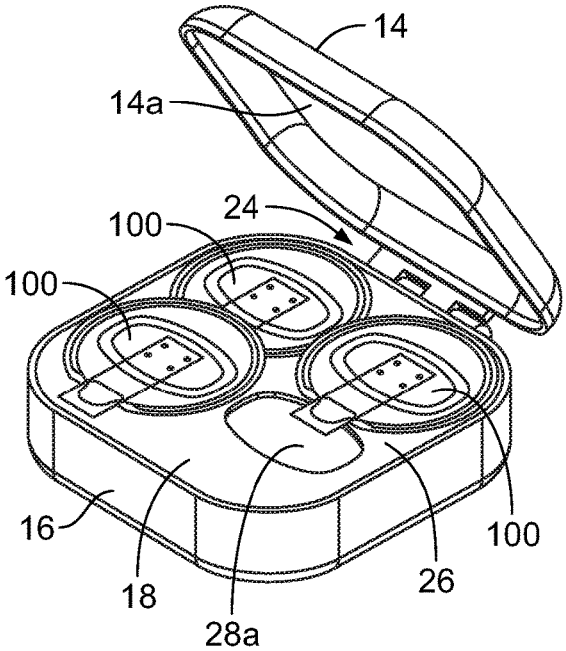
Figure 5:
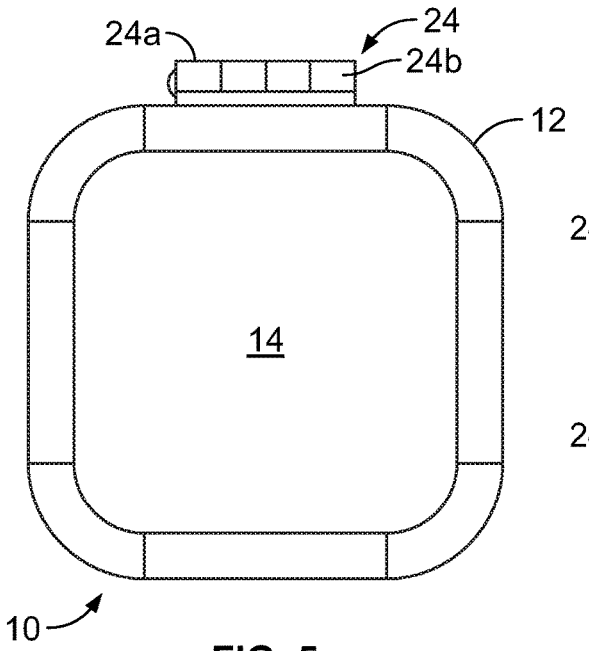
FIG. 5 is a top plan view of the invention shown in FIG. 1.
Figure 6:
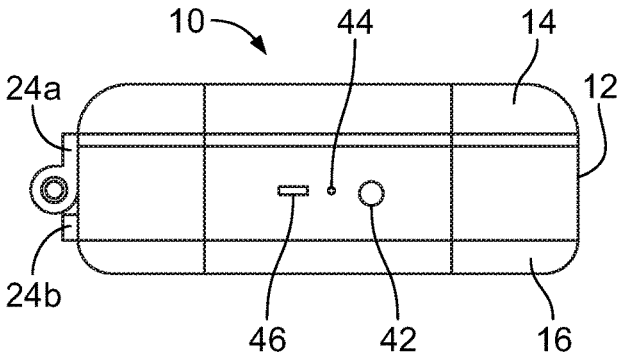
FIG. 6 is a side elevation view of the invention shown in FIG. 1.

The storage unit 18 in this embodiment comprises a sheet of substrate material 26 with a plurality of storage receptacles 28, namely, a first, second, third, and fourth storage receptacle 28*a-d*. The plurality of storage receptacles 28 are formed into the sheet of substrate material 26 as cutouts through which individual applicators 100 insert (FIGS. 2, 4). In another embodiment, the plurality of receptacles 28 can be formed directly into the sheet of substrate material as depressions. The outer perimeter of the sheet of substrate material 26 is sized to fit snuggly within the lower housing element 16. Adhesive or bonding methods can also be employed to secure the sheet of substrate material 26 to the lower housing element 14 and secure the storage unit 18 in place within the housing 12.

Figure 16:
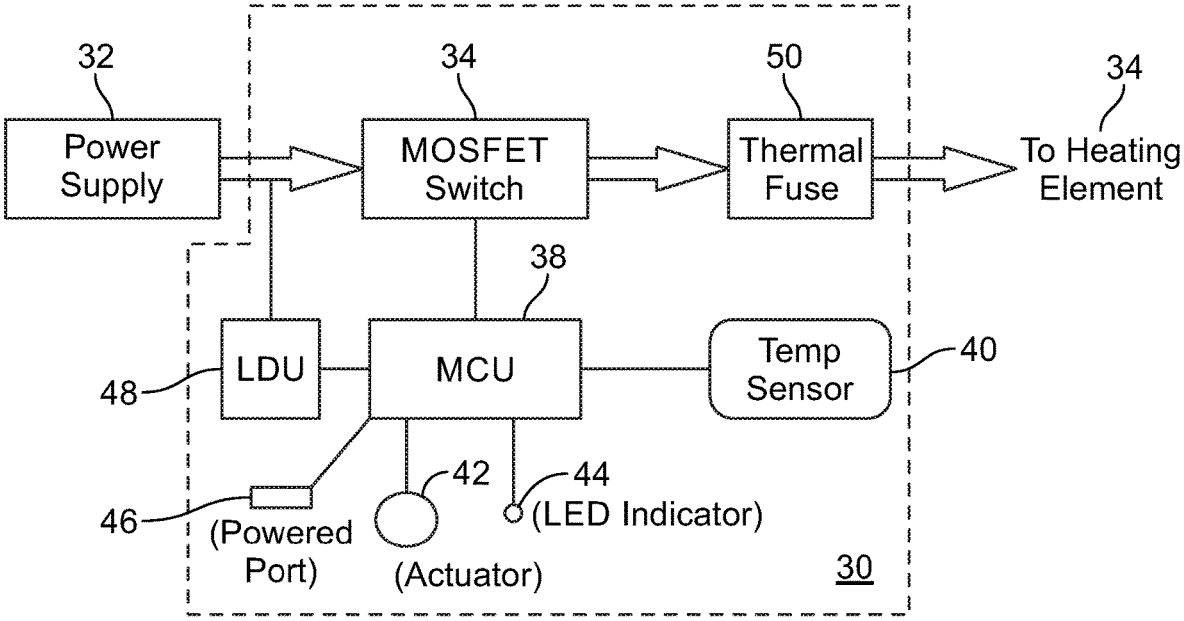
FIG. 16 is a schematic drawing of an electrical component of the invention shown in FIG. 1 and FIG. 9.

The warming unit 20 comprises a control circuit 30 operatively associated with a power supply 32 and at least a first heating element 34. The control circuit 30 facilitates energizing of the first heating element 34 with power from the power supply 32, warming of the at least a first heating element 34 and warming chamber 22 to a selected, pre-programmed elevated temperature, and overall monitoring of the device 10 to insure safe operation. FIG. 16 shows a schematic drawing of an electrical control circuit 30 suitable for use with all embodiments of the invention described herein. The warming unit 20 is designed in one embodiment to operate from a power supply 32 comprising a rechargeable lithium ion battery rated at 3.7V/5 W of output. It is contemplated the warming unit 20 can operate with other power supplies with suitable modifications to the control circuit 30 as may be required, e.g., the warming unit can utilize a cigarette lighter as a power supply with proper voltage regulation and/or AC-DC conversion as may be necessary.

Returning to FIG. 16, the power supply 32 feeds to a MOSFET switch 36 to regulate the power passing to the at least a first heating element 34. The MOSFET switch 36 along with a microcontroller (MCU) 38 provides control and measurement functions of the warming unit 20. The MCU 38 sequences control signals, measures temperature with a temperature sensor 40, and provides user interface controls for an actuator button 42, a visual indicator 44 (including at least a first LED located on the outside of the lower housing element (FIG. 6), and a powered port 46 (FIG. 6) for recharging the power supply 32 or powering an auxiliary device (mobile phone or tablet computer) from the power supply 32. The powered port 46 is in the form of a USB A, B, or C port, micro USB port, or other suitable powered port configuration with power and data capabilities. A linear low dropout (LDO) voltage regulator 48 provides the operating power to the MCU 38 and visual indicator 44. Commercially available wiring, wiring harnesses, and connectors (not shown) are used to electrically connect the controller circuit, power supply, heating elements, and user interface devices.

One user interface control function of the MCU 38 is to process actuator button 42 pushes to select the desired operating mode of the device 10. Depressing the actuator button 42 for a first time period signals the MCU 38 to run a program energizing the heating element 34 or elements for a first time period to achieve a first desired temperature for the at least a first heating element 34 and in the first warming chamber 22. The MCU 38 causes the LED indicator 44 to illuminate to a specific color and/or remain illuminated for a specific time period or intermittingly to indicate device 10 operating status. For the cosmetic preparations, sundry preparations, and topical medications and pharmaceuticals held within the impregnatable pad applicator units shown in FIGS. 14, 15, the desired warming temperature range is 115-125° F. At this temperature range there is generally no degradation of the contents and the contents are not dispensed at temperature likely to burn the skin of the applicator user. To achieve this desired temperature the MCU 38 enables the power supply 32 to energize the first heating element 34 for approximately 30 seconds. The MCU 38 can be programmed with a different warming routine, with the second routine triggered by depressing the actuator button 42 for a second time period. The second routine may energize the at least a first heating element 34 for different time period, resulting in a second warming temperature of the warming chamber 22, and also prompt a second set visual cues by the LED indicator 44. The MCU 38 may also trigger visual cues for other device 10 status, including when the power supply 32 requires recharging or when recharging is complete, when an auxiliary device is drawing power from the power supply 32 through the powered port 46, and the like.

The temperature control function of the MCU 38 energizes the first heating element 34, monitors the temperature of the first heating element 34 and the first warming chamber 22, de-energizes the first heating element 34 at the conclusion of a programmed warming routine, monitors the status of the power supply 32 and powered port 46 for temperature irregularities, and monitors the device 10 for over-temperature situations and to execute emergency safeguards and device shutdown procedures. The temperature sensor 40 is operatively connected with the MCU 38 and monitors the temperature of the at least a first heating element 34, warming chamber 22, and power supply 32. A timer routine is programmed into the MCU 38 for scheduling routine system checks and for energizing the at least a first heating element 34 for the time period in accordance with the selected operation of the device 10. A thermal fuse 50 disposed between the MOSFET switch 36 and the at least a first heating element 34 opens the circuit and de-energizes the at least a first heating element 34 before the heating element or elements and/or warming chamber 22 reach a critical, over-temperature where device components can melt or become combustible. Once tripped, the thermal fuse 50 requires replacement and not merely resetting. This safeguard promotes careful examination of the device 10 before regular operation can continue. The MCU 38 and temperature sensor 40 also monitor the temperature of the power supply 32 during recharging and can disable the powered port 46 if a charging irregularity is identified to prevent damage to the power supply 32 and device 10.

A mechanical thermostat can also be utilized as a suitable substitute for the microprocessor-based control circuit 30. When the actuator button is depressed for the trigger time the power supply 32 provides current to the heating element 34 for prescribed time period pre-programmed into the mechanical thermostat to achieve a desired temperature. The mechanical thermostat variation enables operation at a single temperature.

The power supply 32 comprises a 3.7V rechargeable lithium ion battery providing 5 W of power to the at least a first heating element 34. This power supply holds a charge for 1-2 weeks and is capable of providing power up to 30 heating cycles on a single charge. The first heating element 34 of the present embodiment is a flexible heating pad 52 wrapped to define a first receiving space or raceway 54 and defining the warming chamber 22 into which one of the plurality of storage receptacles 26 overlies when the device 10 is fully assembled. While a single flexible heating pad 52 is shown in FIG. 8, a first and second heating pad can be used when beneficial or necessary to define the first warming chamber 22.

A first heating pad 52 or multiple heating pads may be utilized to define the first receiving space 54 and is dependent on space considerations within the lower housing element 16 and temperature requirements for the warming chamber 22, e.g., temperature and heating rate. A seen in FIG. 8, the internal compartment 16*a* of the lower housing element 16 can accommodate a plurality of warming chambers, namely, a first and second warming chamber 22, 23 defined by a first and second receiving space 54, 55. In the current embodiment, each heating pad 52 is formed from a polyamide film substrate with conductive filaments on the film. A reflective foil layer 56 covers the film and filaments to distribute the generated heat throughout the pad. A suitable insulator layer (not shown) may also be employed when the upper and/or lower housing elements 14, 16 is comprised of metal or other conducive material. An insulator layer is not required when the housing 12 is made of plastic, composite, or other non-conductive materials. In an alternative embodiment the flexible heating pad 40 may be replaced with a ceramic heating element. The ceramic heating element will withstand more heating/cooling cycles than the flexible heating pad. Weight and flexibility considerations result in the ceramic heating element not being suitable for all applications of the present invention.

Figure 3:
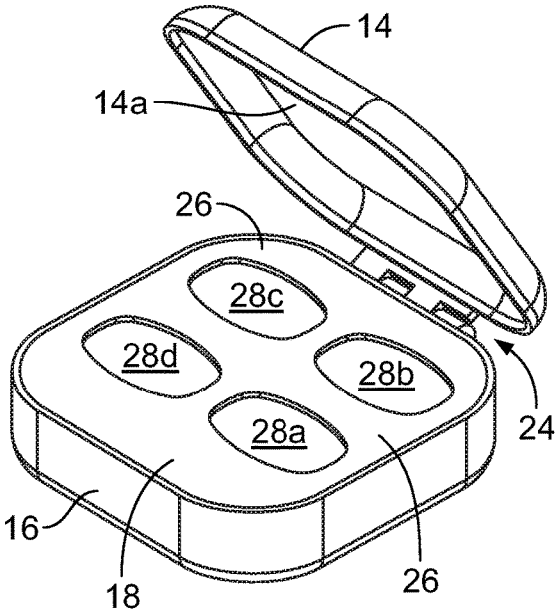
Figure 7:
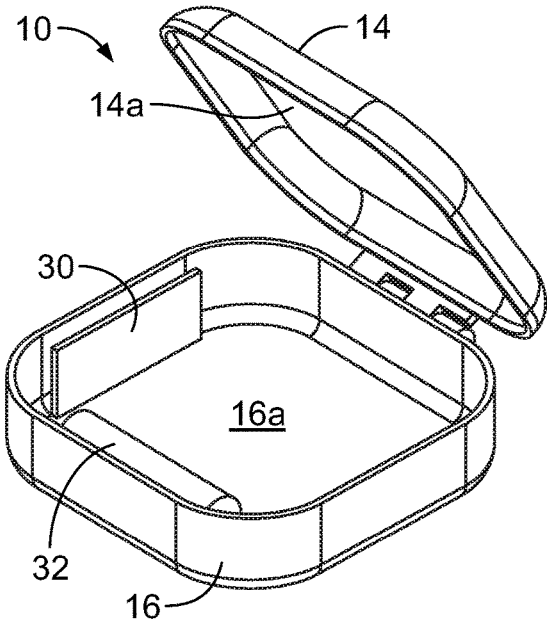
FIGS. 7-8 are isometric views components of the invention shown in FIG. 1.
Figure 8:
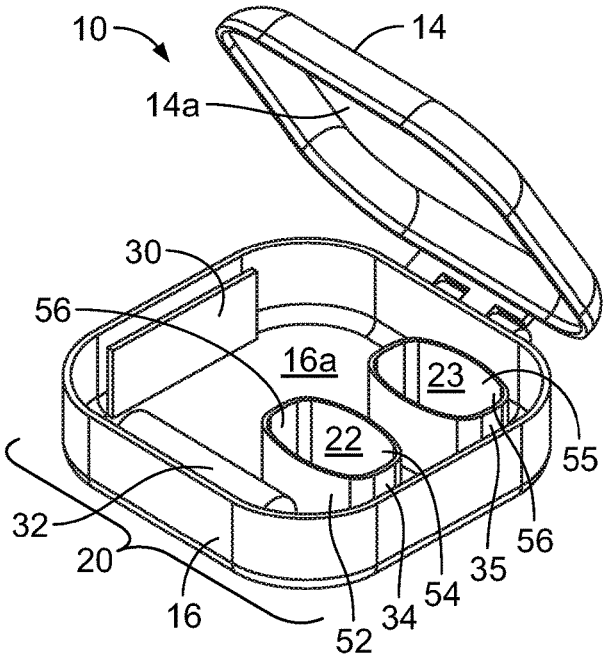
Figure 9:
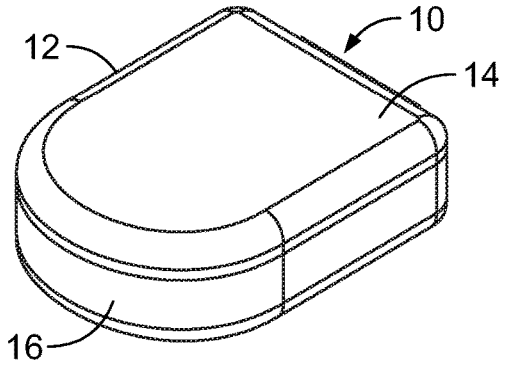
FIG. 9 is an isometric view of a second embodiment of the present invention.
Figure 10:
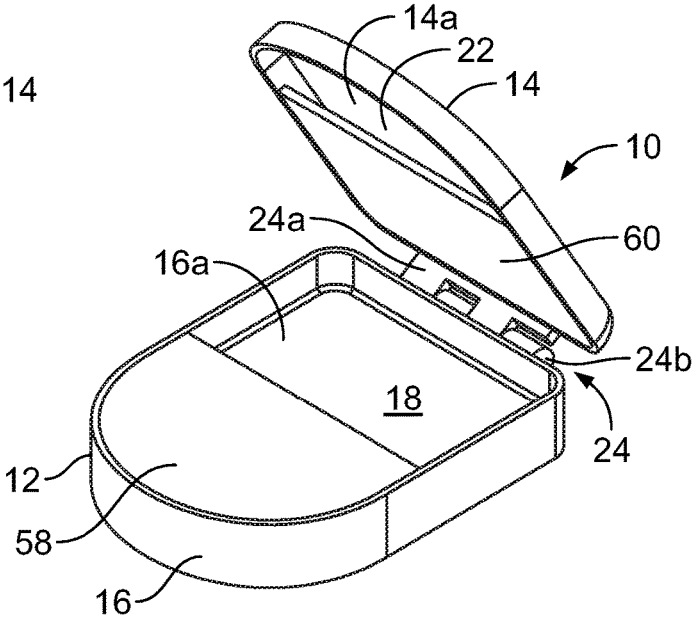
FIG. 10 is an isometric view of the invention shown in FIG. 9.
Figure 11:
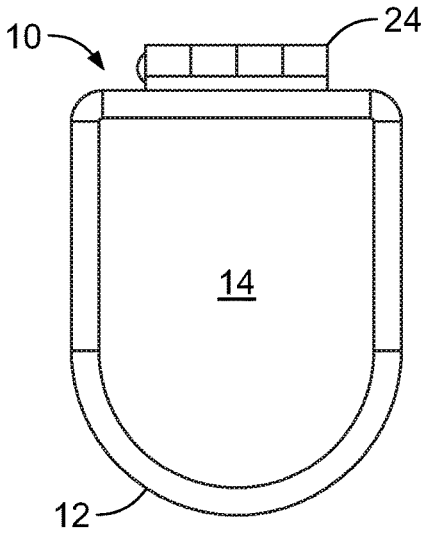
FIG. 11 is a top plan view of the invention shown in FIG. 9.
Figure 12:
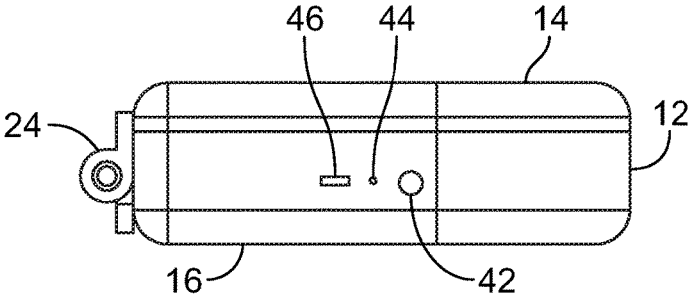
FIG. 12 is a side elevation view of the invention shown in FIG. 9.

As shown in FIGS. 7, 8, the control circuit 30 and power supply 32 are spaced around the periphery of the lower housing element 16. This provides for maximum space within the lower housing element 16 available for accommodating the first warming chamber 22 or the plurality of warming chambers, and storage receptacles 26 of varying arrangement, size, and shape. FIG. 3 shows the plurality of storage receptacles 26 in a first arrangement and orientation. The spacing between the plurality of storage receptacles 26 prevents heating from the first warming chamber 22 inadvertently or unintentionally warming applicator units outside the warming chamber 22. A first warming chamber 22 is shown in FIG. 8.

Figure 15:
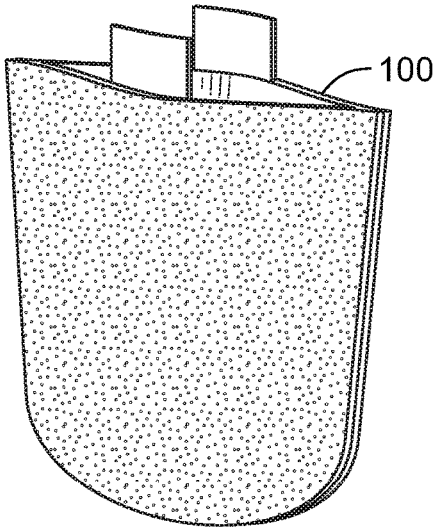

In operation of a storage and warming device 10 of the embodiment one or more of impregnatable pad applicators 100 of the type shown in FIG. 15 (and described in greater detail in Intl. Application No. PCT/US2017/037066, the contents of which are herein incorporated by reference) are placed into the plurality of storage receptacles 26 of the storage unit 18 for storage and safekeeping. A first 26*a* of the plurality of storage receptacles 26 extends into the first warming chamber 22 to heat the contents of the impregnatable pad applicator 100. The applicator includes a reservoir portion 102 for holding the contents and that extends into the storage receptacle 26. The remainder of the plurality of storage receptacles are non-active in terms of providing warming and merely provide storage to the fluid applicator units 100. When needed, a fluid applicator unit 100 from a non-active storage receptacle can be moved to the active storage receptacle with heating functionality to warm the contents of the fluid applicator unit 100

FIGS. 9-14 show a second embodiment of the inventive impregnatable pad applicator unit storage and warming device. Like the previously described embodiment, the device 10 comprises a housing 12 with upper and lower housing elements 14, 16, with a hinge 24 connecting housing elements together to form clamshell housing. The internal space 16*a* of the lower housing element 16 defines a space or well defining the storage space 18 and to hold components of the warming unit 20. The internal space 14*a* of the upper housing element 14*a* defines a space or well for the warming chamber 22. In the current embodiment, the storage unit 18 is configured to hold impregnatable pad applicators 100 in the configuration shown in FIG. 16 (and described in greater detail in Intl. Application No. PCT/US2018/016374, the contents of which are herein incorporated by reference).

The control circuit 30 and power supply 32 components of the warming unit also fit into the internal space 16*a* of the lower housing element 16 and are connected via wire to the at least a first heating element 34 in the first warming chamber 22 in the internal space 14*a* of the upper housing unit 14. The wire runs through a channel in the hinge 24. A first plate 58 inserts into the lower housing element 14 to partially close off the internal space 14*a*. The first plate 58 snuggly fits in place and can be secured by adhesive or bonding as may be necessary. The first plate 58 is also sized to secure a single or plurality of impregnatable pad applicators 100 with the storage space 18 while providing ease of access thereto. A second plate 60 snuggly fits in place in the upper housing element 14 and may be secured by adhesive or bonding as may be necessary and partially closes the internal space 14*a*. As seen in FIG. 13 the heating element 34 comprises a first and a second heating element 34*a*, 34*b* on opposite sides of the internal space 14*a* to 'sandwich' the applicator 100 during warming by the device 10. The device 10 may also function properly using a single heating element on the second plate 60 or floor of the internal space 14*a*.

In operation, a single or plurality of applicator units 100 may be held in the storage unit 18 until warming is necessary. An applicator unit is transferred from the storage unit 18 to the warming chamber 22 and the warming sequence proceeds. When the device 10 is not in operation, the warming chamber 22 can also be utilized to store an extra applicator unit 100. The storage unit 18 and warming chamber 22 in the present embodiment are also suitable for holding and warming sachets and cosmetic facemasks.

While the present invention has been described in connection with a specific application, this application is exemplary in nature and is not intended to be limiting on the possible applications of this invention. It will be understood that modifications and variations may be affected without departing from the spirit and scope of the present invention. It will be appreciated that the present disclosure is intended as an exemplification of the invention and is not intended to limit the invention to the specific embodiments illustrated and described. The disclosure is intended to cover, by the appended claims, all such modifications as fall within the scope of the claims.

I claim:

1. A storage and warming device, the device comprising:

a housing including an upper housing element and a lower housing element having a lower housing volume, the upper and lower housing elements attached by a connector;

a power supply, a controller, and a heating element all disposed within the lower housing volume;

wherein the heating element comprises a flexible heating pad that is wrapped upon itself to define a free standing tubular side wall of a warming chamber, the free standing tubular side wall oriented so that a first end of the free standing tubular side wall is closed by an internal surface of the lower housing element, and a second end of the free standing tubular side wall is open and configured to receive a reservoir of an impregnatable pad applicator.

2. The device of claim 1, wherein the heating element comprises a plurality of flexible heating pads wrapped upon themselves to define a plurality of free standing tubular side walls of a plurality of warming chambers, wherein the plurality of free standing tubular side walls is oriented so that first ends of the plurality of free standing tubular side walls are closed by the internal surface of the lower housing element, and the second ends of the plurality of free standing tubular side walls are open and each configured to receive a reservoir of an impregnatable pad applicator.

3. The device of claim 2, wherein the storage unit further comprises a sheet of substrate material disposed over the second open ends of the plurality of free standing tubular side walls to cover the lower housing volume, wherein the sheet of substrate material includes a cutout aligned with each of the second open ends thereby allowing access to each of the warming chambers.

4. The device of claim 2, wherein the power supply comprises a battery, and the controller and the battery are spaced around the periphery of the lower housing volume.

5. The device of claim 1, wherein the controller energizes the heating element with power from the power supply to elevate the temperature of the heating element to a first, predetermined temperature for a predetermined time period.

6. The device of claim 1, wherein the free standing tubular side wall of the warming chamber has the shape of a raceway.

7. The device of claim 1, further comprising an impregnatable pad applicator having a reservoir disposed within the warming chamber.

8. The device of claim 1, further comprising a powered port configured to recharge the power supply and provide power to an auxiliary device.

9. The device of claim 1, wherein the heating element comprises a polyimide film and filament flexible heating pad.

10. The device of claim 7, wherein the contents of the reservoir of the impregnatable pad applicator comprise a cosmetic preparation, a topical medication, or a topical pharmaceutical.

11. A storage and warming device, the device comprising:

a housing including an upper housing element having an upper housing volume and a lower housing element having a lower housing volume, the upper and lower housing elements attached by a connector;

a power supply and a controller disposed within the lower housing volume;

a first plate disposed on the upper housing element covering a portion of the upper housing volume while leaving access to the upper housing volume; and a first heating element disposed within the upper housing volume;

wherein either the first heating element is disposed on an internal surface of the upper housing element facing the first plate so that a space between the first heating element and the first plate defines a warming chamber configured to receive an impregnatable pad applicator, or wherein the first heating element is disposed on an internal surface of the first plate facing an internal surface of the upper housing element so that a space between the first heating element and the internal surface of the upper housing element defines a warming chamber configured to receive an impregnatable pad applicator; and further comprising a second plate disposed on the lower housing element covering a portion of the lower housing volume while leaving access to the lower housing volume, so that a space between the second plate and an internal surface of the lower housing element defines a storage space configured to store a plurality of additional impregnatable pad applicators.

12. The device of claim 11, further comprising the plurality of additional impregnatable pad applicators disposed within the storage space.

13. The device of claim 11, further comprising a second heating element disposed within the upper housing volume;

wherein the first heating element is disposed on the internal surface of the upper housing element facing the first plate, and the second heating element is disposed on an internal surface of the first plate facing the internal surface of the upper housing element so that a space between the first and second heating elements defines the warming chamber configured to receive the impregnatable pad applicator.

14. The device of claim 13, further comprising the impregnatable pad applicator disposed within the warming chamber.

* * * * *